US009805700B1

(12) United States Patent
Roe

(10) Patent No.: US 9,805,700 B1
(45) Date of Patent: Oct. 31, 2017

(54) APPARATUS FOR OPERATING A BRASS INSTRUMENT BY FOOT PEDALS

(71) Applicant: Catherine E. Roe, Puyallup, WA (US)

(72) Inventor: Catherine E. Roe, Puyallup, WA (US)

(73) Assignee: Catherine E. Roe, Puyallup, WA (US)

( * ) Notice: Subject to any disclaimer, the term of this patent is extended or adjusted under 35 U.S.C. 154(b) by 0 days.

(21) Appl. No.: 15/393,079

(22) Filed: Dec. 28, 2016

Related U.S. Application Data

(60) Provisional application No. 62/272,683, filed on Dec. 30, 2015.

(51) Int. Cl.
*G10D 9/04* (2006.01)
*G10D 7/10* (2006.01)

(52) U.S. Cl.
CPC ..... *G10D 9/04* (2013.01); *G10D 7/10* (2013.01)

(58) Field of Classification Search
CPC ..... G10G 5/00; G10G 7/00
See application file for complete search history.

(56) References Cited

U.S. PATENT DOCUMENTS 2,358,605 A * 9/1944 Strane ..... G10D 9/04 84/388
8,633,365 B2 * 1/2014 May ..... G10D 13/026 84/387 A

* cited by examiner

*Primary Examiner* — Kimberly Lockett
(74) *Attorney, Agent, or Firm* — Evergreen Valley Law Group; Kanika Radhakrishnan

(57) ABSTRACT

An apparatus for operating a tuba comprises a board facilitating mounting one or more foot pedal units. Each foot pedal unit is connected to at least one rotary valve of the tuba, and comprises a pedal mounted to a frame using a drive unit and a chain. The chain is configured to run over a pulley member and is coupled at top portion of the frame. Upon pressing the pedal in sync with air supplied at mouthpiece of the tuba by a user, the chain is pulled through the pulley member causing a mallet shaped shaft to move in upward or downward direction. The movement of the mallet shaped shaft is configured to control movement of a paddle of at least one rotary valve via a cable for enabling the user to play all chromatic notes available within the tuba's range.

16 Claims, 4 Drawing Sheets

APPARATUS FOR OPERATING A BRASS INSTRUMENT BY FOOT PEDALS

TECHNICAL FIELD

The present invention generally relates to brass instruments such as a tuba, and more specifically, to an apparatus for operating a tuba using one or more foot pedals.

BACKGROUND

A brass instrument such as a tuba is a type of musical instrument that produces sound by vibration of air inside a hollow tubular resonator in synchrony with the vibration of air flowing from the lips of the user playing the tuba. There are many types of tubas such as but not limited to bass tubas, contrabass tubas, sub contrabass tubas, tenor tubas and the like. Typically, a tuba comes in variable sizes (between 3 to 5.5 meters) and includes a mouthpiece and one or more valves (e.g., piston valves, rotary valves etc.). The one or more valves in the tuba are used for selecting specific harmonic notes available in the tuba. A user has to rest the lower end of the tuba on his/her thighs and upper end of the tuba is held by the user's arms and hands. For playing the tuba, the user blows air into the mouthpiece and presses the one or more valves by hand to produce the different chromatic pitches/harmonics.

However, it is not possible for physically disabled individuals who are unable to use their arms or hands (i.e., upper limbs) to operate the one or more valves necessary for playing the tuba. There are some physically disabled individuals who can still use their lower limbs (i.e., feet), but the current musical instrument and instrument accessory companies do not produce or sell appropriate products for accommodating such needs of the physically disabled individuals who can use their feet to play the tuba or any other such brass instruments.

In the light of the above discussion, there appears to be a need for an apparatus for operating a brass instrument with foot pedals.

OBJECT OF INVENTION

The principal object of the embodiments herein is to allow physically disabled individuals to use their feet to operate pedals associated with one or more foot pedal units. The foot pedal units have a cable connected to the respective pedals as well as the corresponding valves of a brass instrument.

Another object of the embodiments herein is to provide easily accessible foot pedal units for the users to operate in synchronization with provisioning a focused stream of air flow at the mouthpiece of the brass instrument.

Yet another object of the embodiments herein is to allow the users to adjust the brass instrument to a required height using the brass instrument holding stand.

SUMMARY

The above-mentioned needs are met by an apparatus for operating a brass instrument with foot pedals.

An example of the apparatus includes a board mounted to a brass instrument holding stand. The apparatus also includes one or more foot pedals units mounted on the board using screws and fastening means wherein the foot pedal units comprises of a plurality of configurations. Further, the apparatus includes a plurality of rotary valves for operating the brass instrument, wherein each foot pedal unit is connected to at least one rotary valve of the brass instrument using a cable. Furthermore, the apparatus includes a brass instrument stand configured to hold the brass instrument at different angles based on the preference of a user, wherein the brass instrument stand clasps the brass instrument using one or more clamps for holding the brass instrument at a required angle to accommodate the user to play the brass instrument. Moreover, the apparatus includes a bottom portion of the stand attached to a bottom portion of the board.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE VIEWS OF DRAWINGS

In the accompanying figures, similar reference numerals may refer to identical or functionally similar elements. These reference numerals are used in the detailed description to illustrate various embodiments and to explain various aspects and advantages of the present disclosure.

The drawings referred to in this description are not to be understood as being drawn to scale except if specifically noted, and such drawings are only exemplary in nature.

DETAILED DESCRIPTION OF THE EMBODIMENTS

The above-mentioned needs are met by providing an apparatus for operating a brass instrument by foot pedals. The following detailed description is intended to provide example implementations to one of ordinary skill in the art, and is not intended to limit the invention to the explicit disclosure, as one or ordinary skill in the art will understand that variations can be substituted that are within the scope of the invention as described.

The best and other modes for carrying out the present invention are presented in terms of the embodiments, herein depicted in FIGS. 1 to 3A-3B. The embodiments are described herein for illustrative purposes and are subject to many variations. It is understood that various omissions and substitutions of equivalents are contemplated as circumstances may suggest or render expedient, but are intended to cover the application or implementation without departing from the spirit or scope of the present invention.

Further, it is to be understood that the phraseology and terminology employed herein are for the purpose of the description and should not be regarded as limiting. Any heading utilized within this description is for convenience only and has no legal or limiting effect.

The terms "a" and "an" herein do not denote a limitation of quantity, but rather denote the presence of at least one of the referenced item.

Figure 1:
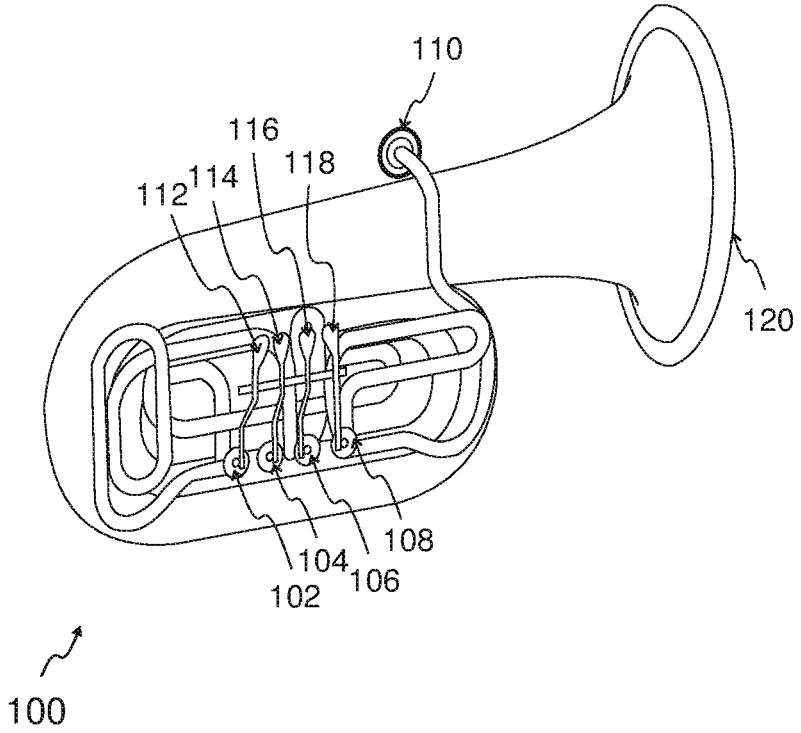
FIG. 1 illustrates a front perspective view of a tuba including rotary valves, in accordance with an example scenario, according to the embodiments as disclosed herein.

FIG. 1 illustrates a front perspective view of a tuba 100 including one or more rotary valves, in accordance with an example scenario. The tuba 100 is a kind of a brass instrument typically made of brass and sometimes may be electroplated or lacquered with other metals such as but not limited to gold, silver, nickel and the like. In the example representation of the tuba 100 as shown in FIG. 1, the tuba 100 includes four rotary valves 102, 104, 106 and 108 (hereinafter referred collectively as the rotary valves 102-108) for operating the tuba 100. It is noted that the tuba 100 is shown to include only four rotary valves (the rotary valves 102-108) for example purposes only, and that the tuba 100 may include fewer or more number of rotary valves. Moreover, the tuba 100 may also be constructed using but not limited to one or more piston valves (not shown in figures).

As shown in FIG. 1, the rotary valves 102-108 are configured to produce different harmonics when selectively pressed by a user in sync with vibration of a focused stream of air flowing from the user's lips applied in a mouthpiece 110 provided on the tuba 100. More specifically, the user presses a paddle associated with each of the rotary valves such as paddles 112, 114, 116 and 118 (hereinafter collectively referred as 'the paddles 112-118') to activate the respective rotary valves 102-108 to produce specific pitches or notes in the tuba 100. The tuba 100 includes a hollow tubular cavity which produces sound by vibration when air flow is streamed inside the hollow tubular cavity by the user. The produced sound comes out of a bell shaped horn 120 protruding from a tapered section of the tuba 100, as shown in FIG. 1. The tuba 100 is usually placed on the user's lap with the bell shaped horn 120 pointing a fair distance away from the mouthpiece 110. The rotary valves 102-108 may then be pressed by the user's fingers while applying a focused stream of air flow for producing different pitches of sound. Although a user with normal use of their upper extremities can use his/her hands and upper limbs to conveniently operate the tuba 100, however it is difficult to operate for the physically disabled individuals who are unable to use their arms or hands for operating the paddles 112-118 associated with the rotary valves 102-108 for playing the tuba 100.

Various embodiments of the present invention provide solutions for facilitating the ability of physically disabled individuals to operate a tuba (such as the tuba 100) using foot pedal units, and these solutions overcome the above described and other limitations, in addition to providing currently unavailable benefits. It is understood that, the present invention is explained herein with reference to the tuba 100 for example purposes only, and that the present invention may also be applicable to other brass instruments such as but not limited to trumpet, euphonium, French horn, sousaphone, mellophone, saxhorn and the like. Various embodiments of the present invention are herein disclosed with reference to FIGS. 2 and 3A-3B.

Figure 2:
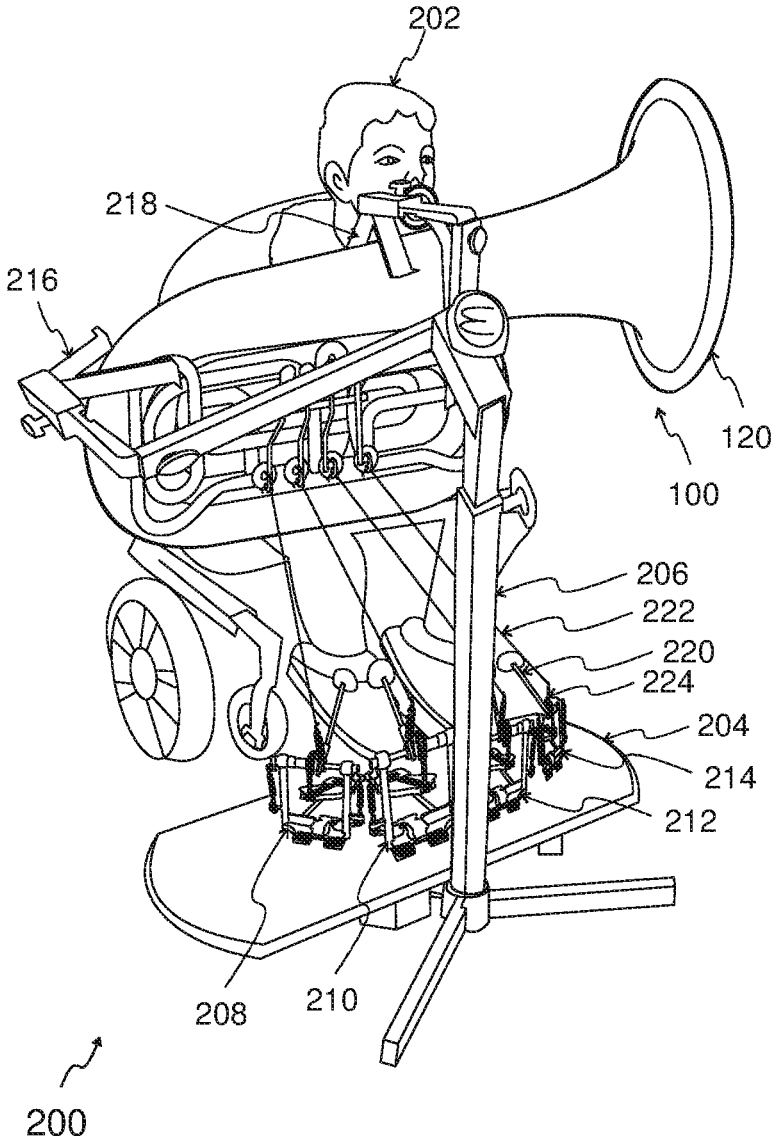
FIG. 2 illustrates a side perspective view of a physically disabled user playing the tuba using an apparatus, in accordance with an embodiment of the present invention, according to the embodiments as disclosed herein.

FIG. 2 illustrates a side perspective view of a physically disabled user 202 playing the tuba 100 using an apparatus 200, in accordance with an embodiment of the present invention. More specifically, the apparatus 200 facilitates operation (i.e., playing) of the tuba 100 for users with physical disability (such as the physically disabled user 202) who come under a mobility impairment category with physical defect due to loss or impairment of upper limbs (i.e., arms or hands). For instance, the physically disabled user 202 (hereinafter also referred as the user 202) on a wheelchair may have a physical defect due to loss of upper limb that may be caused due to one of various reasons such as but not limited to paralysis, amputation, poor manual dexterity, damage to one or more organs of the body, as a consequence of disease, a broken skeletal structure etc. However, the user 202 is also shown to include fully functional lower limbs (i.e., feet or legs). It is noted that the apparatus 200 may also facilitate a normal user with fully operational lower and upper limbs to operate the tuba 100 and may not be limited to facilitating only the physically disabled users with upper limbs impairment/loss.

In an embodiment, the apparatus 200 for operating the tuba 100 includes a board 204 mounted to a tuba holding stand 206. The board 204 includes one or more foot pedal units such as foot pedal units 208, 210, 212 and 214. In an embodiment, the tuba holding stand 206 is coupled with the board 204 for adjusting height and angle of the tuba 100 based on the user's preference. As shown in FIG. 2, the tuba holding stand 206 (hereinafter referred as the 'stand 206') is configured to hold the tuba 100 at different angles based on the preference of the user 202. A bottom portion of the stand 206 is attached to a bottom portion of the board 204 (for example, using screwing or fastening means). The purpose of the tuba holding stand 206 is to clasp the tuba 100 using one or more clamps such as clamps 216 and 218 for holding the tuba 100 at a required angle to accommodate the user 202 to play the tuba 100. The stand 206 may also include provisions for adjusting the tuba 100 at a height easily accessible to the user 202. In another embodiment, the board 204 may not be attached to the stand 206, and the stand 206 may be fully functional as a separate entity for holding the tuba 100 at preferred heights and angles without being attached to the board 204. Moreover, the stand 206 may be of any size and/or shape for holding or adjusting the tuba 100 at preferred heights and angles.

In an embodiment, each of the foot pedal units 208, 210, 212 and 214 (hereinafter collectively referred as the 'foot pedal units 208-214') of the apparatus 200 are fixedly attached to the board 204 using screwing or fastening means (e.g., using bolts and nuts). It is noted that, only four foot pedal units 208-214 are shown in FIG. 2 for example purposes, and that there can be any number of foot pedals included depending on a number of rotary valves (such as the rotary valves 102-108) in the tuba 100. An example foot pedal unit from among the foot pedal units 208-214 is explained in detail with reference to FIGS. 3A and 3B.

Figure 3A:
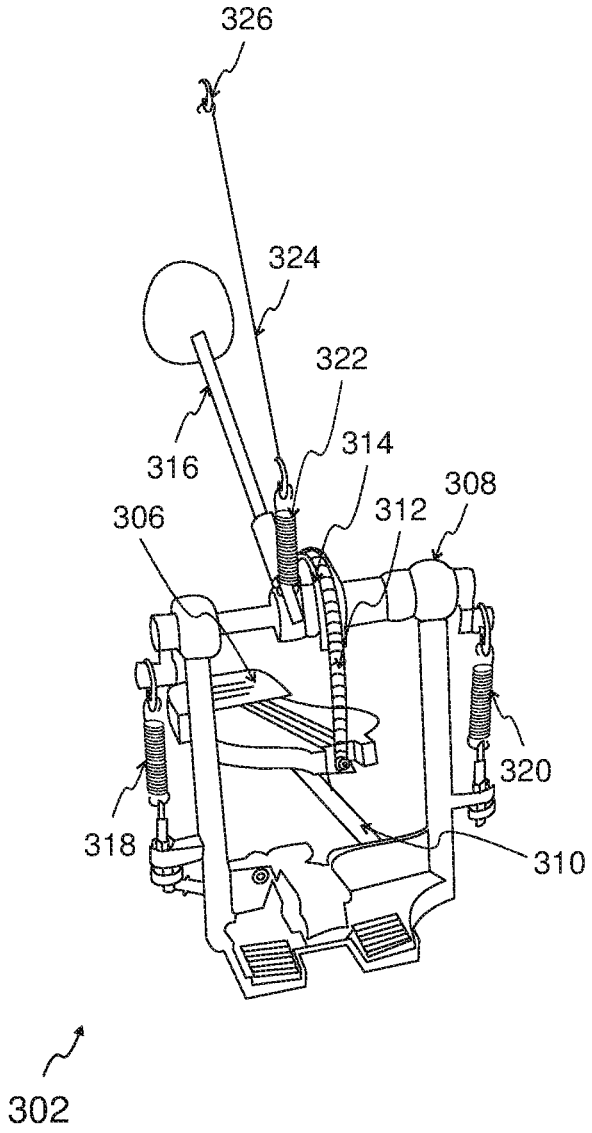
FIGS. 3A and 3B illustrate foot pedal board units for the apparatus for operating the rotary valves of the tuba, in accordance with an embodiment of the present invention.
Figure 3B:
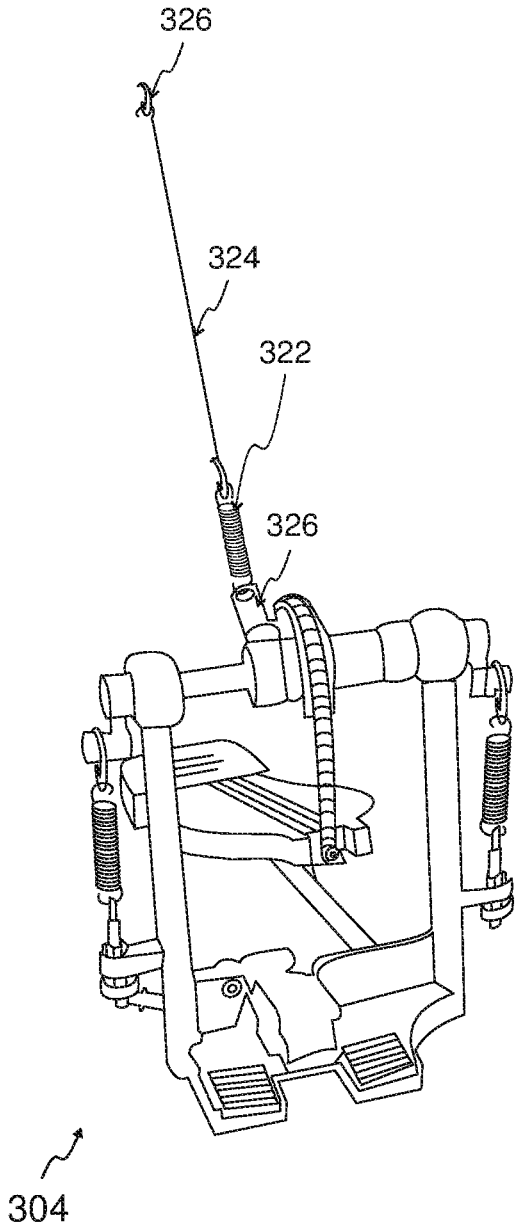

FIGS. 3A and 3B illustrate foot pedal board units 302 and 304 for the apparatus 200 for operating one or more rotary valves of the tuba 100, in accordance with an embodiment of the present invention. In an embodiment, each of the foot pedal board units 208-214 includes at least one type of configuration of foot pedal units from among the foot pedal units 302 and 304 of FIGS. 3A and 3B. In another embodiment, the foot pedal units 208-214 may have a different configuration than those depicted in FIGS. 3A and 3B.

In FIG. 3A, the foot pedal unit 302 is a drum pedal including a pedal 306 configured to be mounted on a frame 308. More specifically, the pedal 306 is attached to the frame 308 using a drive unit 310 at a bottom portion of the frame 308. The pedal 306 further includes a chain or a belt (hereinafter referred as a 'chain 312') movably attached to a top portion of the frame 308 over a pulley member 314, such that when a user presses the pedal 306, the pedal 306 is configured to pull the chain 312 in sync with a downward movement of the drive unit 310 provided at the bottom portion of the pedal 306. In an embodiment, the pedal 306, the frame 308, the drive unit 310 and the chain 312 are made of a material or a combination of materials such as but not limited to metals, wood, rubber, plastic and the like. Further, the chain 312 is configured to run through the pulley member 314 from the top portion of the pedal 306 for controlling an upward or a downward movement of a mallet shaped shaft 316. The frame 308 further includes one or more tension springs 318 and 320 for controlling an amount of force needed to strike the pedal 306 (upon pressing the pedal 306 downwards) and for controlling an amount of recoiling force when the pedal 306 is released. For example, the pedal 306 may be pressed by a user (such as the user 202) in a heel-up technique, a heel-down technique or any other suitable technique for controlling the movement of the mallet shaped shaft 316.

The mallet shaped shaft 316 is a rod shaped shaft including a mallet at a top portion of the mallet shaped shaft 316, which is typically made of materials such as but not limited to wood, plastic, rubber and the like. Upon pressing the pedal 306, the pedal 306 is configured to pull the chain 312 through the pulley member 314 such that the mallet shaped shaft 316 is configured to move either upward or downward with a force. In an embodiment, the movement of the mallet shaped shaft 316 is used to control a movement of a paddle from among the paddles 112-118 associated with the respective rotary valves 102-108 of the tuba 100. As shown in FIG. 3A, a bottom portion of the mallet shaped shaft 316 is connected with a cable 324 via a spring 322. The spring 322 may be used for adjusting tension and/or length of the cable 324. The cable 324 is configured to run from the spring 322 to a respective assigned rotary valve from among the rotary valves 102-108. The cable 324 further includes a hook 326 configured to attach the cable 324 to an assigned paddle (e.g., using a small screw) from among the paddles 112-118. More specifically, by pressing the pedal 306, a user (such as the user 202) may control the movement (either an upward or a downward movement) of the mallet shaped shaft 316 and thereby control the movement of the paddles 112-118 of the tuba 100.

FIG. 3B illustrates the foot pedal unit 304, where the mallet shaped shaft 316 of the foot pedal unit 302 (as shown in FIG. 3A) is replaced by a bracket 328 which includes a provision (such as a hole or a hook) for facilitating one end of the cable 324 to be fixed to the bracket 328 via the spring 322. The other end of the cable 324 may be fixed to at least one paddle from among the paddles 112-118 of the tuba 100 using the hook 326. Moreover, by pressing the pedal 306, a user (such as the user 202) may control the movement (an upward, a downward, a forward or a backward movement) of the bracket 328 and thereby control the movement of connected paddle from among the paddles 112-118 of the tuba 100. It is noted that the bracket 328 may be of any shape or size for provisioning control of the movement of the paddle from among the paddles 112-118 of the tuba 100.

It is noted that, foot pedal units such as the foot pedal units 302 and 304 may be designed in any manner such that when a user presses a pedal or a footplate, a respective cable connected to the pedal or the footplate is configured to be pulled for enabling a respective paddle of a tuba (such as the tuba 100) and thereby enable the user to play chromatic notes available within the tuba's range. For example, the pedal or the footplate may be connected to any of a chain or a belt or a drive mechanism coupled to a mallet shaped shaft, a bracket and the like, for pulling the respective cable.

Referring again to FIG. 2, each foot pedal unit from among the foot pedal units 208-214 is connected to at least one rotary valve from among the rotary valves 102-108 of the tuba 100 using a cable. As explained in FIGS. 3A and 3B, each foot pedal unit from among the foot pedal units 208-214 include a pedal mounted in a frame. The pedal is attached to the frame using a drive unit (such as the drive unit 310) at a bottom portion of the frame. The pedal further includes a chain (such as the chain 312) movably attached to a top portion of the frame over a pulley member (such as the pulley member 314), such that, when the user 202 presses the pedal, the pedal is configured to pull the chain in sync with a downward movement of the drive unit at the bottom portion of the pedal. Further, the frame includes a mallet shaped shaft such as the mallet shaped shaft 316 of FIG. 3A (or a bracket such as the bracket 328 of FIG. 3B) attached to the pulley member such that a movement of the chain over the pulley member causes a movement (upward or downward movement) of the mallet shaped shaft.

In an embodiment, each of the mallet shaped shafts associated with the foot pedal units 208-214 is connected to a respective paddle from among the paddles 112-118 using a cable (such as the cable 324). Further, a hook (such as the hook 326) may be included for fixing the cable (e.g., using a small screw) to each of the respective paddles 112-118 at one end, and a string (such as the string 322) may be included near the mallet shaped shaft for adjusting tension and/or length of the cable. For example, the foot pedal unit 214 is shown to be attached to the paddle 118 of the rotary valve 108. More specifically, the foot pedal unit 214 includes a mallet shaped shaft 220 connected to the paddle 118 via a cable 222 extending from the mallet shaped shaft 220 through a spring 224 and attached to the paddle 118 using a hook (not visible in FIG. 2).

In an embodiment, when the user 202 presses a pedal of a foot pedal unit from among the foot pedal units 208-214, a movement (an upward or a downward movement) of a respective mallet shaped shaft is configured to trigger a movement of a respective paddle of the tuba 100. Thereby, a user may play the tuba 100, by applying a focused stream of air at the mouthpiece 110 and synchronously controlling a respective pedal associated with a respective foot pedal unit. For example, the user 202 may provide a focused stream of air flow at the mouthpiece 110 and synchronously press one or more pedals associated with the foot pedal units 208-214 for playing the tuba 100.

Various embodiments of the present invention (explained in conjunction with FIGS. 1 to 3A-3B) advantageously provide an apparatus for facilitating a physically disabled user, who has the ability to use his/her feet, to operate a tuba. More specifically, the present invention applies for physically disabled individuals who do not have use of their arms or hands and do have the ability to use their feet. Such users can use their feet to operate pedals associated with one or more foot pedal units that have a cable connected to the respective pedals as well as the corresponding valves of the tuba. Moreover, the foot pedal units are easily accessible for the users to operate in sync with provisioning a focused stream of air flow at the mouthpiece of the tuba. Accordingly, when the pedals are pushed by a user, respective cables pull on appropriate valves of the tuba to then play appropriate notes. The users may also adjust the tuba to a required height or angle using the tuba holding stand. Additionally, the present invention may also be applicable to other brass instruments such as but not limited to a trumpet, a euphonium, a French horn, a sousaphone, a mellophone, a saxhorn and the like.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Accordingly, the disclosure of the present invention is intended to be illustrative, but not limiting, of the scope of the invention, which is set forth in the following claims.

The invention claimed is:

1. An apparatus for operating a brass instrument with foot pedals, the apparatus comprising:

a board mounted to a brass instrument holding stand;

one or more foot pedal units mounted on the board using screws and fastening means wherein the one or more foot pedal units comprises of a plurality of configurations;

a plurality of rotary valves for operating the brass instrument, wherein each of the one or more foot pedal unit is connected to at least one rotary valve of the brass instrument using a cable;

a brass instrument stand configured to hold the brass instrument at different angles based on the preference of a user, wherein the brass instrument stand clasps the brass instrument using one or more clamps for holding the brass instrument at a required angle to accommodate the user to play the brass instrument;

a bottom portion of the stand attached to a bottom portion of the board; and a pedal mounted to a frame using a drive unit at the bottom portion of the stand, wherein each of the one or more foot pedal unit comprises the pedal.

2. The apparatus of claim 1 wherein the one or more foot pedal unit further comprises:

a chain movably attached to a top portion of the frame over a pulley member.

3. The apparatus of claim 2 wherein the pedal is configured to pull the chain in synchronization with a download movement of the drive unit at the bottom portion of the pedal when the user presses the pedal using feet.

4. The apparatus of claim 2 wherein the frame comprises a mallet shaped shaft attached to the pulley member such that a movement of the chain over the pulley member causes a movement of the mallet shaped shaft.

5. The apparatus of claim 2 wherein upon pressing the pedal in synchronization with air supplied at mouthpiece of the brass instrument by a user, the chain is pulled through the pulley member causing a mallet shaped shaft to move in upward or downward direction.

6. The apparatus of claim 5 wherein the movement of the mallet shaped shaft is configured to control movement of a paddle of at least one rotary valve through a cable for enabling the user to play all chromatic notes available within the brass instruments range.

7. The apparatus of claim 6 wherein the user presses a paddle associated with each of the rotary valves to activate the respective rotary valves to produce specific pitches or notes in the brass instrument.

8. The apparatus of claim 2 wherein the pedal further comprises a chain movably attached to a top portion of the frame over a pulley member, wherein when the user presses the pedal, the pedal is configured to pull the chain in synchronization with a downward movement of the drive unit at the bottom portion of the pedal.

9. The apparatus of claim 8 wherein the chain is configured to run through the pulley member from the top portion of the pedal for controlling one of an upward and downward movement of a mallet shaped shaft.

10. The apparatus of claim 1 wherein the rotary valves are configured to produce different harmonics when selectively pressed by a user in synchronization with vibration of a focused stream of air flowing from the users lips applied in a mouthpiece provided on the brass instrument.

11. The apparatus of claim 1 wherein the brass instrument stand is of various sizes and shapes for holding and adjusting the brass instrument at preferred heights and angles.

12. The apparatus of claim 1 wherein the brass instrument stand comprises of provisions for adjusting the brass instrument at a height easily accessible to the user.

13. The apparatus of claim 2 wherein the frame further comprises one or more tension springs for controlling an amount of force needed to strike the pedal and control an amount of recoiling force when the pedal is released.

14. The apparatus of claim 2 wherein the mallet shaped shaft comprises a mallet at a top portion of the mallet shaped shaft and a bottom portion is connected with a cable through a spring, wherein the spring is used for adjusting tension and length of the cable, wherein the cable further comprises a hook configured to attach the cable to an assigned paddle.

15. The apparatus of claim 1 wherein the user presses the pedal and subsequently a respective cable connected to the pedal is configured to be pulled for enabling a respective paddle of a brass instrument thereby enabling the user to play chromatic notes available within the brass instruments range.

16. An apparatus for operating a brass instrument with foot pedals, the apparatus comprising:

a board mounted to a brass instrument holding stand;

one or more foot pedals units mounted on the board using screws and fastening means wherein the foot pedal units comprises of a plurality of configurations;

a plurality of rotary valves for operating the brass instrument, wherein each foot pedal unit is connected to at least one rotary valve of the brass instrument using a cable;

a brass instrument stand configured to hold the brass instrument at different angles based on the preference of a user, wherein the brass instrument stand clasps the brass instrument using one or more clamps for holding the brass instrument at a required angle to accommodate the user to play the brass instrument;

a bottom portion of the stand attached to a bottom portion of the board; and a pedal mounted to a frame using a drive unit at a bottom portion of the frame and a chain movably attached to a top portion of the frame over a pulley member.

* * * * *